US007748109B2

(12) United States Patent
Yagi et al.

(10) Patent No.: US 7,748,109 B2
(45) Date of Patent: Jul. 6, 2010

(54) CRIMPING APPARATUS

(75) Inventors: Satoshi Yagi, Makinohara (JP); Shigeharu Suzuki, Makinohara (JP); Tetsuro Ide, Makinohara (JP); Hideto Kumakura, Makinohara (JP); Kenji Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/969,935

(22) Filed: Jan. 7, 2008

(65) Prior Publication Data

US 2008/0209716 A1 Sep. 4, 2008

(30) Foreign Application Priority Data

Jan. 18, 2007 (JP) ..... 2007-009137

(51) Int. Cl.
*H01R 43/042* (2006.01)
*B26D 1/02* (2006.01)

(52) U.S. Cl. ..... 29/753; 29/747; 29/748; 29/761; 29/463; 83/509

(58) Field of Classification Search ..... 29/753, 29/761, 748, 747, 463; 83/509, 580, 521; 72/192, 338, 339; 439/730; 228/3.1, 4.1
See application file for complete search history.

(56) References Cited

U.S. PATENT DOCUMENTS 3,797,534 A * 3/1974 Skidmore ..... 141/3
4,654,952 A * 4/1987 Baldyga ..... 29/566.2
5,353,625 A * 10/1994 Hoshino et al. ..... 72/416
6,413,695 B1 * 7/2002 Nishi et al. ..... 430/270.1

FOREIGN PATENT DOCUMENTS

JP 61-48681 U 4/1986

* cited by examiner

*Primary Examiner*—Derris H Banks
*Assistant Examiner*—Tai Nguyen
(74) *Attorney, Agent, or Firm*—Sughrue Mion, PLLC

(57) ABSTRACT

A crimping apparatus includes an anvil for supporting a metal terminal including a base plate portion for mounting an electric wire thereon and a pair of crimping piece portions extending upwardly respectively from opposite side edges of the base plate portion, and a crimper which has a press-fastening portion for press-fastening the crimping piece portions. The anvil and the press-fastening portion of the crimper cooperate to press-fasten the crimping piece portions for crimping the crimping piece portions to the electric wire mounted on the metal terminal. The press-fastening portion is subjected to a mirror finish.

3 Claims, 11 Drawing Sheets

CRIMPING APPARATUS

BACKGROUND

This invention relates to a crimping apparatus for crimping a metal terminal (having a pair of crimping piece portions extending upwardly respectively from opposite side edges of a base plate portion thereof) to an electric wire.

There is known one conventional crimping apparatus in which an arc-shaped portion 103 with a radius R1 and an arc-shaped portion 104 with a radius R2 are formed on an upper tooth die 102 of a crimper 101, and are disposed respectively at right and left sides of an imaginary straight line A passing through an apex as shown in FIG. 9, and a pair of crimping piece portions 107 of a metal terminal 106 on which an electric wire 105 is placed are press-deformed (that is, press-fastened to the electric wire 105) by the crimper 101 and an anvil 108 (see, for example, JP-UM-A-61-48681).

In JP-UM-A-61-48681, the crimper 101 is so shaped as to enhance the performance. However, the crimper 101 against which the crimping piece portions 107 strike during the press-fastening (press-deforming) operation is liable to be worn at its surface, and it is difficult to maintain a good surface condition for a long period of time. And, when the stable crimping can not be effected because of wear of the crimper 101, there is a fear that the mechanical performance or the electrical performance may be adversely affected. FIG. 10 is a view of the crimper 101 in its unused condition as seen from a direction B of FIG. 9 (standard finishing), and FIG. 11 is an enlarged view showing the surface of the arc-shaped portion (press-fastening portion) 104 of FIG. 10. Even in the unused condition, pits and projections on the surface can be confirmed.

SUMMARY

This invention has been made in view of the above circumstances, and an object of the invention is to provide a crimping apparatus capable of ensuring stable crimping for a long period of time so as to enhance a mechanical performance and an electrical performance.

1) According to one aspect of the present invention, there is provided a crimping apparatus, comprising:

an anvil for supporting a metal terminal including a base plate portion for mounting an electric wire thereon and a pair of crimping piece portions extending upwardly respectively from opposite side edges of the base plate portion; and a crimper which has a press-fastening portion for press-fastening the crimping piece portions, wherein the anvil and the press-fastening portion of the crimper cooperate to press-fasten the crimping piece portions for crimping the crimping piece portions to the electric wire mounted on the metal terminal; and wherein the press-fastening portion is subjected to a mirror finish.

In the invention recited in the above Paragraph 1), when the crimper is moved downward toward the anvil having the base plate portion of the metal terminal placed thereon, the press-fastening portion of the crimper is brought into striking engagement with the pair of crimping piece portions of the metal terminal to plastically deform these crimping piece portions. At this time, since the press-fastening portion of the crimper for striking against the pair of crimping piece portions of the metal terminal has the mirror finish, a friction developing between the press-fastening portion and the pair of crimping piece portions is small, and therefore the crimping piece portions can be stably crimped to the electric wire by the press-fastening portion, and a mechanical performance and an electrical performance can be enhanced.

2) According to another aspect of the invention, there is provided a crimping apparatus, comprising:

an anvil for supporting a metal terminal including a base plate portion for mounting an electric wire thereon and a pair of crimping piece portions extending upwardly respectively from opposite side edges of the base plate portion; and a crimper which has a press-fastening portion for press-fastening the crimping piece portions, wherein the anvil and the press-fastening portion of the crimper cooperate to press-fasten the crimping piece portions for crimping the crimping piece portions to the electric wire mounted on the metal terminal; and wherein the press-fastening portion is subjected to hard chrome plating.

In the invention recited in the above Paragraph 2), when the crimper is moved downward toward the anvil having the base plate portion of the metal terminal placed thereon, the press-fastening portion of the crimper is brought into striking engagement with the pair of crimping piece portions of the metal terminal to plastically deform these crimping piece portions. At this time, since the hard chrome plating layer is formed on the press-fastening portion of the crimper for striking against the pair of crimping piece portions of the metal terminal, a friction developing between the press-fastening portion and the pair of crimping piece portions is small, and therefore the crimping piece portions can be stably crimped to the electric wire by the press-fastening portion. And besides, thanks to the formation of the hard chrome plating layer, the surface of the press-fastening portion has increased hardness, and therefore is hardly worn. Thus, the good surface condition can be maintained for a long period of time, so that the mechanical performance and the electrical performance can be enhanced.

3) Preferably, hard chrome plating is applied onto the mirror finish of the press-fastening portion.

In the invention recited in the above Paragraph 3), when the crimper is moved downward toward the anvil having the base plate portion of the metal terminal placed thereon, the press-fastening portion of the crimper is brought into striking engagement with the pair of crimping piece portions of the metal terminal to plastically deform these crimping piece portions. At this time, since the hard chrome plating layer is formed on the mirror finished portion formed on the press-fastening portion of the crimper for striking against the pair of crimping piece portions of the metal terminal, a friction developing between the press-fastening portion and the pair of crimping piece portions is small, and therefore the crimping piece portions can be stably crimped to the electric wire by the press-fastening portion. And besides, since the hard chrome plating layer is further formed on the mirror finished portion, the surface of the press-fastening portion has increased hardness, and therefore is hardly worn. Thus, the good surface condition can be maintained for a long period of time, so that the mechanical performance and the electrical performance can be enhanced.

4) Preferably, the mirror finish has surface roughness Ra of not more than 0.1 μm.

In the invention recited in the above Paragraph 4), the mirror finished portion has the surface roughness Ra of not more than 0.1 μm, and therefore the press-fastening portion can be caused to strike against the crimping piece portions with a small friction, and therefore the pair of crimping piece portions can be plastically deformed in a stable manner while applying a crimping force uniformly to the crimping piece portions.

The crimping apparatus of the invention can solve a problem that it is difficult to maintain the good surface condition for a long period of time, which would adversely affect the mechanical performance and the electrical performance. Therefore, there can be provided the crimping apparatus capable of ensuring the stable crimping for a long period of time so as to enhance the mechanical performance and the electrical performance.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Preferred embodiments of the present invention will now be described with reference to the drawings.

First Embodiment

Figure 1:
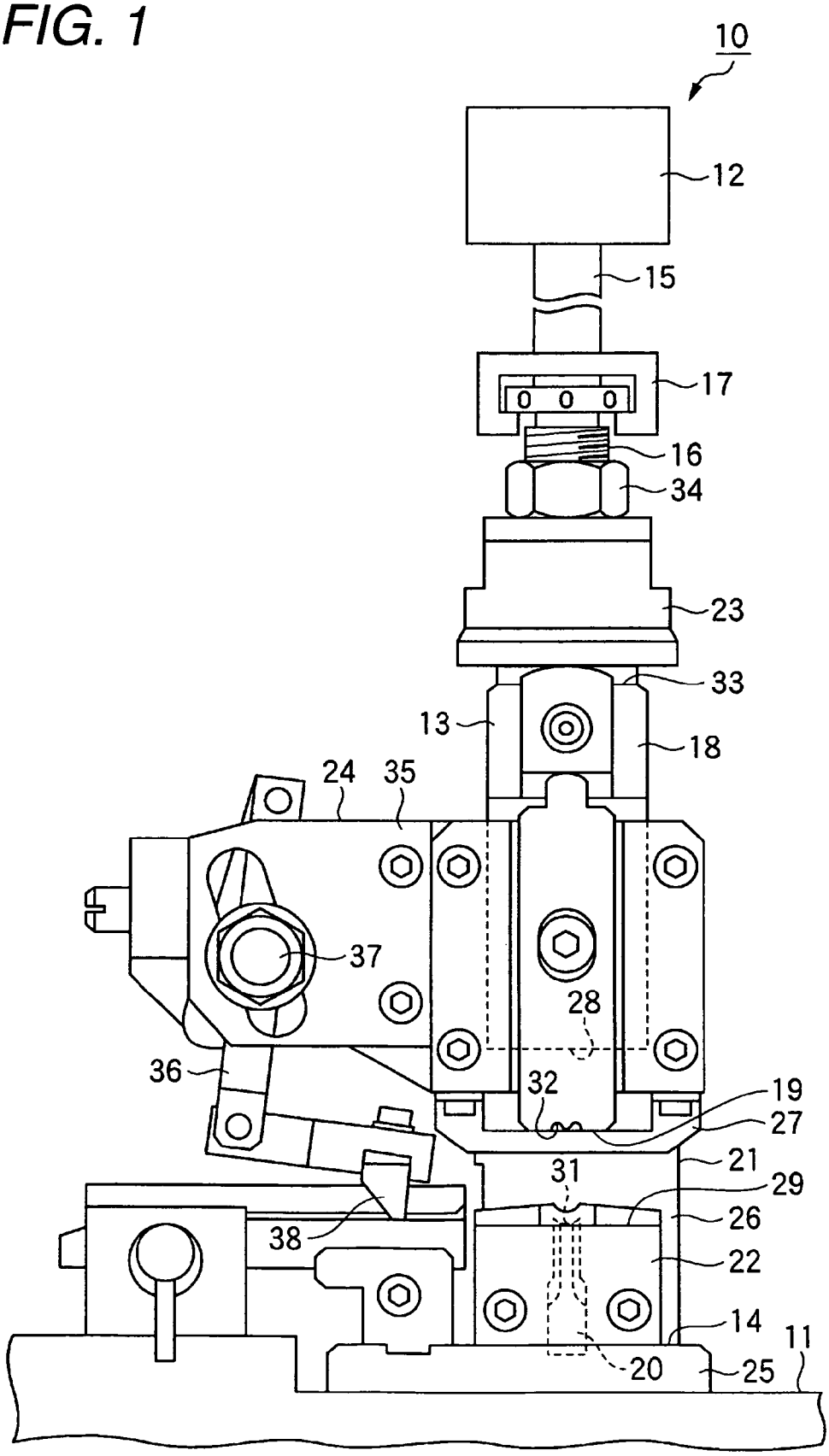
FIG. 1 is a front-elevational view of a first embodiment of a crimping apparatus of the present invention.
Figure 2:
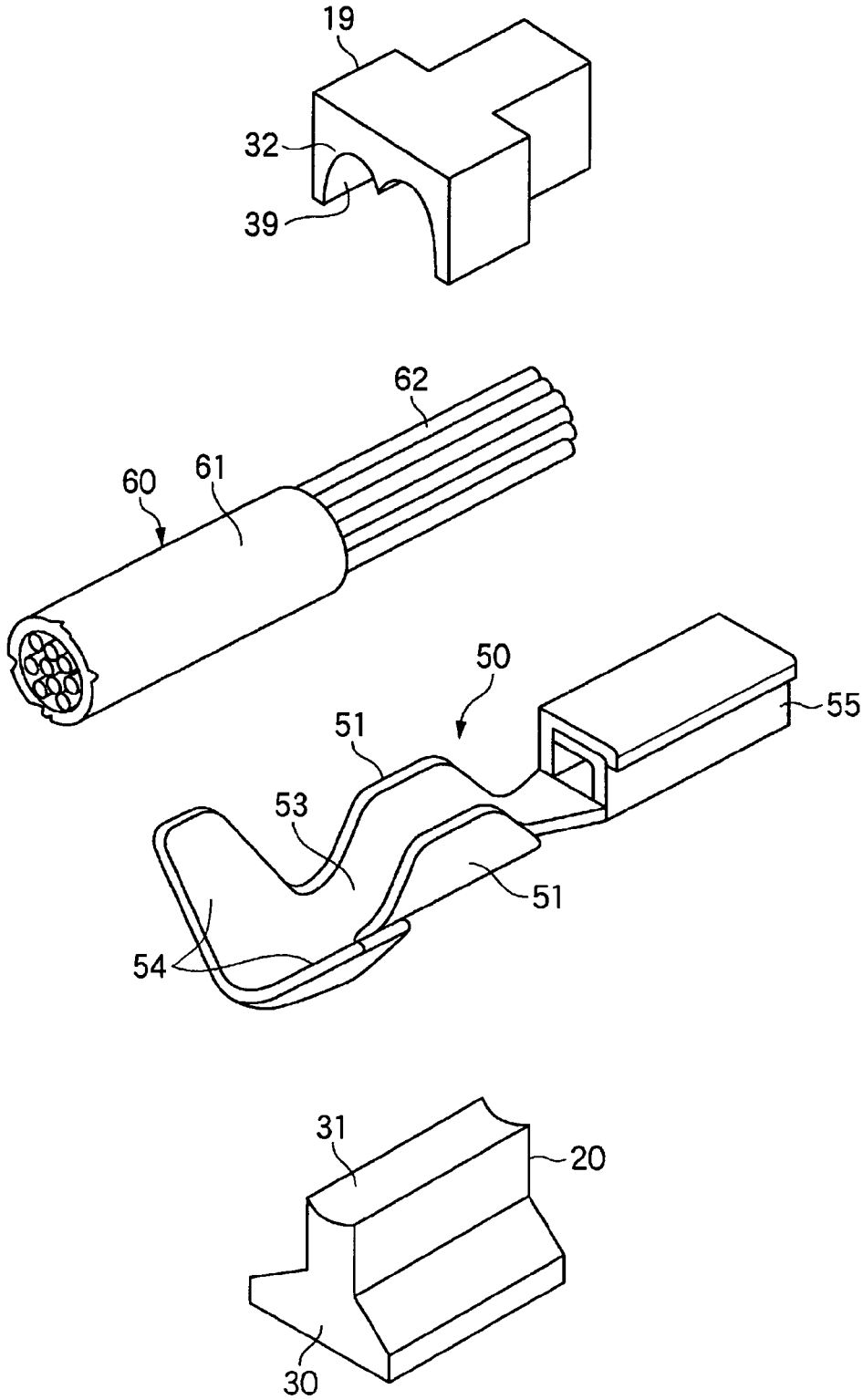
FIG. 2 is a perspective view showing a metal terminal and a crimper and an anvil used in the crimping apparatus of FIG. 1.
Figure 3:
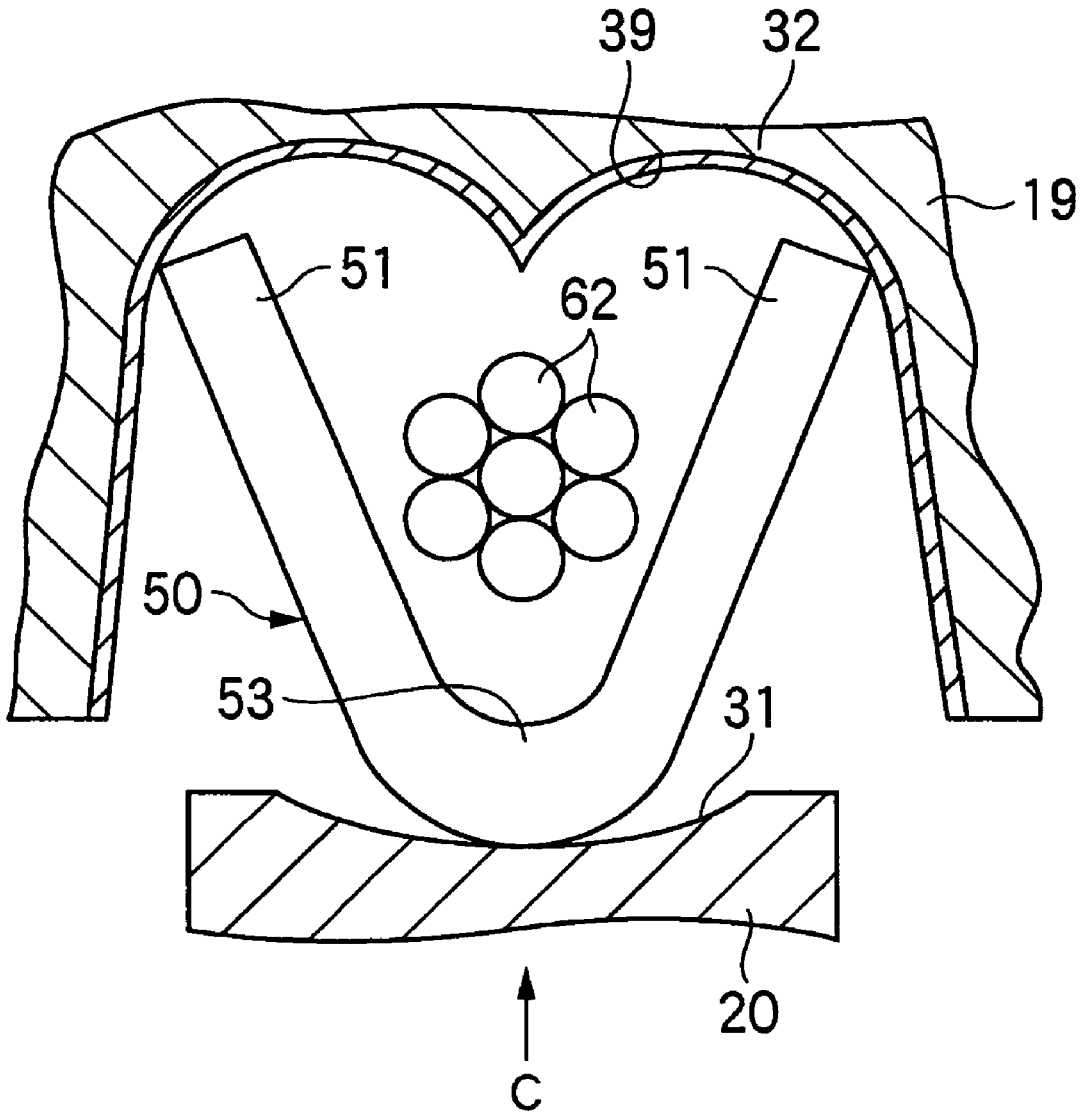
FIG. 3 is an enlarged cross-sectional view of an important portion of the crimping apparatus of FIG. 1.
Figure 4:
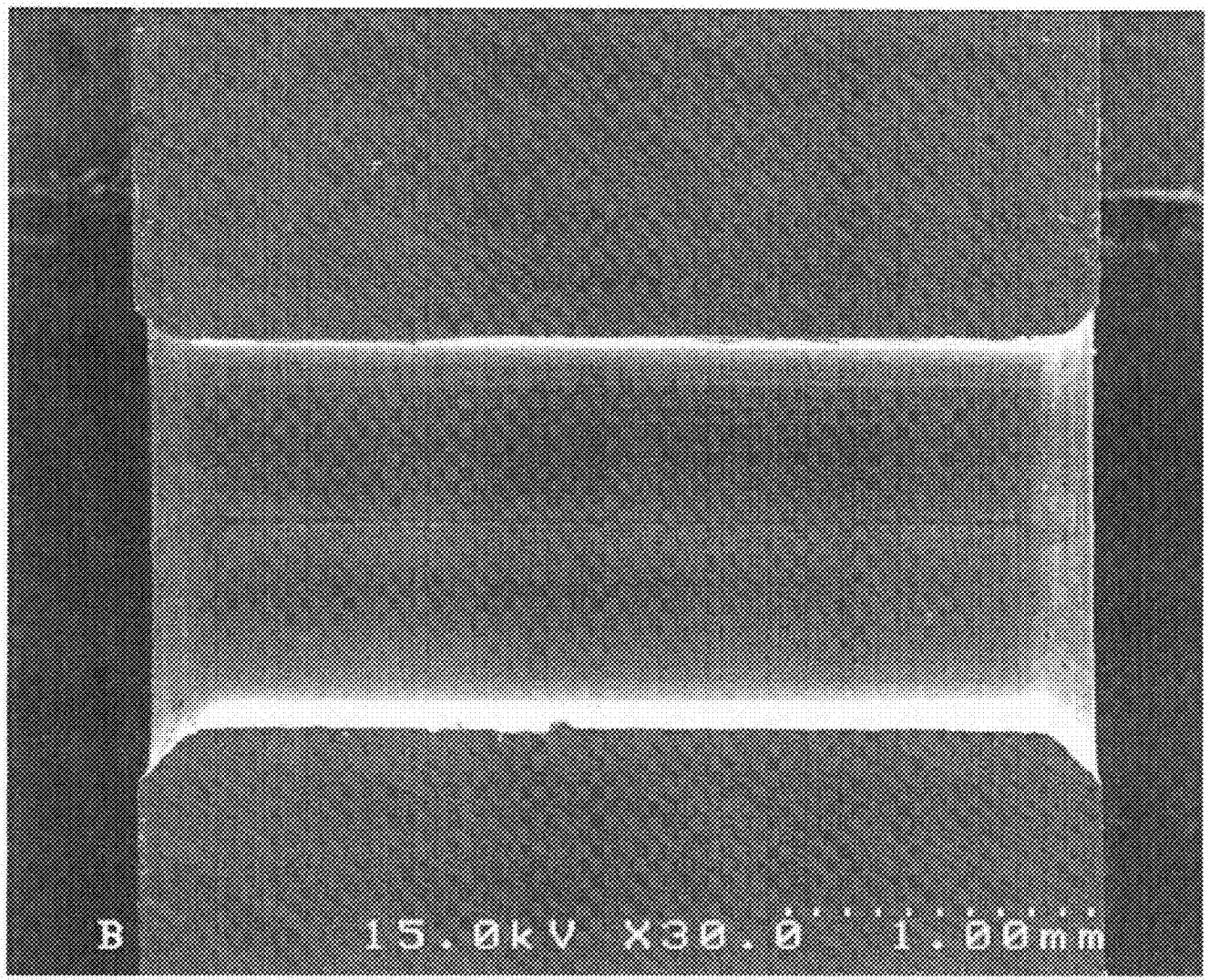
FIG. 4 is a view of the crimper in its unused condition as seen from a direction C of FIG. 3.
Figure 5:
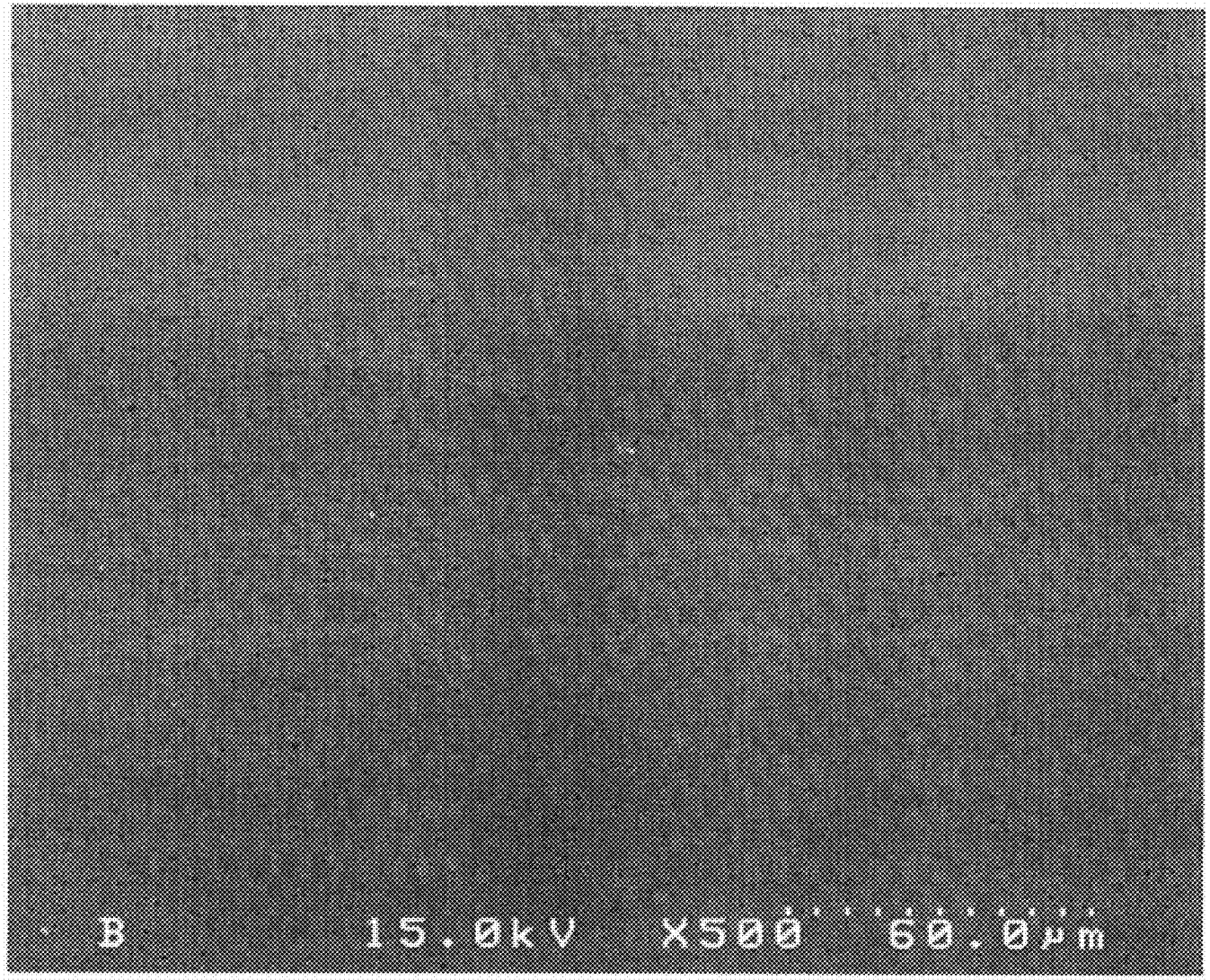
FIG. 5 is an enlarged view showing a surface of a mirror-finished press-fastening portion of FIG. 4.
Figure 6:
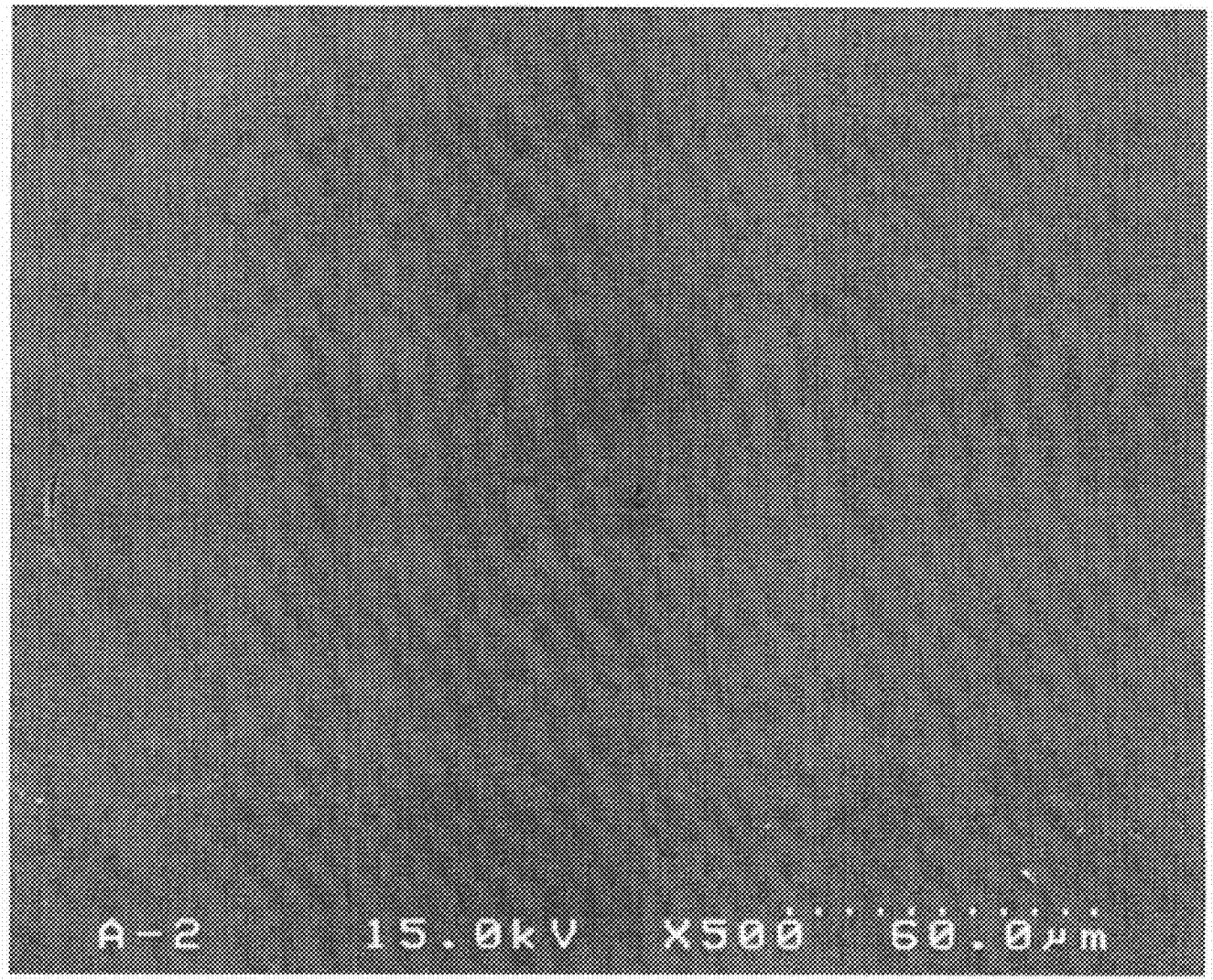
FIG. 6 is an enlarged view showing the surface of the press-fastening portion of FIG. 5 in its used condition.

FIGS. 1 to 3 show a first embodiment of a crimping apparatus of the invention and a metal terminal, and FIG. 1 is a front-elevational view of the crimping apparatus of the first embodiment, FIG. 2 is a perspective view showing the metal terminal and a crimper and an anvil used in the crimping apparatus of FIG. 1, FIG. 3 is an enlarged cross-sectional view of an important portion of the crimping apparatus of FIG. 1, FIG. 4 is a view of the crimper in its unused condition as seen from a direction C of FIG. 3, FIG. 5 is an enlarged view showing the surface of a mirror-finished press-fastening portion of FIG. 4, and FIG. 6 is an enlarged view showing the surface of the press-fastening portion of FIG. 5 in its used condition.

As shown in FIGS. 1 and 2, the crimping apparatus 10 of the first embodiment comprises a base 11 placed on a floor or the like, a drive source 12, and a crimping applicator 13 for crimpingly connecting the metal terminal 50 to an electric wire 60.

The base 11 has a flat portion 14 which is generally flat in a horizontal direction. The crimping applicator 13 is placed and supported on the base 11.

The drive source 12 comprises a servomotor (not shown), a drive shaft 15 for transmitting a driving force, and a hook 17 engaged with a disk portion (not shown) of a shank 16. A rotational motion of the servomotor is converted into a linear motion via a piston-crank mechanism so as to move a ram 18 upward and downward. Instead of the servomotor, a hydraulic cylinder having a piston rod connected to the shank 16 in directly-driving relation or other suitable drive means may be used.

The crimping applicator 13 includes the crimper 19, and the anvil 20. The crimper 19 is moved downward to press-deform crimping piece portions 51 of the metal terminal 50, thereby crimping the crimping piece portions 51 to a core wire 62 of the electric wire 60.

Various forms of metal terminals can be used as the metal terminal 50 which is to be press-fastened by the crimping applicator 13. For example, a female metal terminal having a box-like electrical contact portion, a male terminal having a tab-like electrical contact portion, a joint metal terminal for connecting two wires together, etc., can be used.

The metal terminal 50 is formed by forming an electrically-conductive sheet into a predetermined shape by blanking and then by bending it. The metal terminal 50 includes a pair of sheath clamping piece portion 54 to be crimped to a sheath 61 of the electric wire 60, a curved base plate portion 53 on which that portion of a core wire 52 of the electric wire 60 from which the sheath 61 has been removed is adapted to be placed, a pair of core wire crimping piece portions 51 extending upwardly respectively from opposite side edges of the base plate portion 53, and a box-like electrical contact portion 55 for contact with a mating terminal.

The pair of core wire crimping piece portions 51 of the metal terminal 50 are press-fastened (press-deformed) or bent inwardly by the downward movement of the crimper 19, and therefore are crimped to the core wire 62 of the electric wire 60 to be electrically connected thereto. The pair of sheath crimping piece portions 54 are press-fastened inwardly, and are fixed to the sheath 61 of the electric wire 60.

A rotational motion of the servomotor is converted into a linear motion by the piston-crank mechanism so as to move the ram 18 (holding the crimper 19) upward and downward, thereby moving the crimper 19 upward and downward. There is provided a control portion (not shown) for controlling the upward and downward movement of the ram 18, and this control portion effects various controls including the acceleration, deceleration, crimping movement and standing-by of the ram 18.

The crimping applicator 13 comprises a frame 21, a holder 22 having the anvil 20, the ram 18 supported on the frame 21, a ram bolt 23 threadedly engaged with the ram 18 so as to enable the upward and downward movement of the ram 18, the shank 16 threadedly engaged with the ram bolt 23, and a terminal feed unit 24.

The frame 21, when viewed from the side thereof, has a generally recumbent U-shape, and includes a mounting portion 25 on which the holder 22 is mounted, an upwardly-extending support post portion 26, and a ram support portion 27.

The frame 21 is placed on the flat portion 14 of the base 11, and is fixed thereto to bolts and nuts (not shown). The frame 21 may be integrally fixed to the base 11.

The ram support portion 27 is connected to an upper end portion of the support post portion 26 extending upwardly from the mounting portion 25 on which the holder 22 is mounted. A space for guiding the ram 18 is formed in the ram support portion 27, and the ram 18 is slidably fitted in this space.

The anvil 20 for the placing of the metal terminal 50 thereon is embedded in the holder 22. The holder 22 has a flat surface 29 opposed to both of the crimper 19 and a lower end surface 28 of the ram 18. Namely, the flat surface 29 is disposed substantially perpendicularly to both of the direction of movement of the ram 18 and a direction of movement of the crimper 19.

The anvil 20 is received and held in the holder 22, and in this condition the holder 22 is mounted on the mounting portion 25 of the frame 21. The anvil 20 is held in the holder 22, with its bottom plate 30 disposed in intimate contact with a bottom wall of the holder 22, and therefore the anvil 20 can support the metal terminal 50 thereon without being shaken.

The anvil 20 has a concavely-curved contact surface 31 for abutting against the base plate portion 53 of the metal terminal 50, and upon application of a pressing force from the crimper 19, the anvil 20 cooperates with the crimper 19 to press-deform the core wire crimping piece portions 51 of the metal terminal 50 into a predetermined shape.

The ram 18 has a generally rectangular parallelepiped shape. The ram 18 is supported in the ram support portion 27 so as to move upward and downward in the vertical direction. A longitudinal axis of the ram 18 extends in the direction of movement thereof, that is, in the vertical direction. The lower end surface 28 of the ram 18 is flat, and is perpendicular to the direction of movement of the ram 18.

The crimper 19 is provided at a lower half portion of the ram 18 in opposed relation to the anvil 20. The ram 18 is supported in the ram support portion 27 so as to move upward and downward, and therefore the crimper 19 can be moved toward and away from the anvil 20. In other words, the crimper 19 is moved toward and away from the anvil 20 in accordance with the downward and upward movement of the ram 18.

The crimper 19 is in the form of a generally rectangular parallelepiped-shaped plate, and a press-fastening portion 32 of a generally arch-shape is formed at an inner surface of the crimper 19 opposed to the anvil 20. The press-fastening portion 32 is formed into a curved shape or generally arc-shape so as to press-deform each core wire crimping piece portion 51 of the metal terminal 50 into a generally C-shape.

The ram bolt 23 is threaded into a threaded hole formed in an upper end surface 33 of the ram 18, and therefore is mounted on the ram 18. By thus mounting the ram bolt 23 on the ram 18, the ram 18 can be moved upward and downward.

The shank 16 has a hollow cylindrical shape. The disk portion formed at one end of the shank 16 is connected to the hook 17 of the drive source 12, and a screw portion formed at the other end of the shank 16 is threaded in a screw hole in the ram bolt 23. Namely, the shank 16 transmits a driving force of the drive source 12 to the ram 18 via the ram bolt 23 so as to move the crimper 19 upward and downward.

The amount of threading of the shank 16 in the screw hole of the ram bolt 23 can be adjusted, and therefore the shank 16 is mounted on the ram bolt 23 in such a manner that the position of the shank 16 relative to the ram bolt 23 can be changed. When the position of the shank 16 relative to the ram bolt 23 is changed by adjusting the amount of threading of the shank 16 in the screw hole of the ram bolt 23, the distance (gap) between the anvil 20 and the crimper 19 is also changed.

The shank 16 has a nut 34 threaded on an externally-threaded portion thereof, and the nut 34 is tightened, with the shank 16 threaded in the screw hole of the ram bolt 23, and by doing so, the ram bolt 23 and the shank 16 can be fixed to each other.

The terminal feed unit 24 comprises a cam (not shown) provided at a side portion of the ram 18, a connecting rod (not shown) adapted to abut against the cam to be moved in the horizontal direction, a lever support portion 35 receiving the connecting rod therein, a crank-like lever 36 fitted in the lever support portion 35, a pivot shaft 37 supporting the lever 36 in a manner to allow a pivotal movement of the lever 36, and a terminal feed claw 38 provided at a distal end portion of the lever 36.

In the terminal feed unit 24, the cam is moved downward by the driving force of the drive source 12, and at this time the connecting rod abuts at its one end against the cam, and is pushed to be moved in the horizontal direction, so that the other end portion of the connecting rod is brought into abutting engagement with the lever 36, and the lever 36 is pivotally moved about the pivot shaft 37. As a result, the terminal feed claw 38 is engaged in a feed hole in a chain-like band having a series of metal terminals 50, and feeds this chain-like band in a terminal feeding direction to feed one metal terminal at a time to a crimping position.

As shown in FIGS. 3 to 5, a mirror finished portion 39 is formed on the surface of the press-fastening portion 32 of the crimper 19. The mirror finished portion 39 has surface roughness Ra of not more than 0.1 μm.

In the crimping apparatus 10, the base plate portion 53 of the metal terminal 50 is placed on the contact surface 31 of the anvil 20, and the core wire 62 of the electric wire 60 is placed on the base plate portion 53.

Then, when the ram 18 is moved downward, the crimper 19 is moved downward toward the anvil 20. At this time, the mirror finished portion 39 formed on the press-fastening portion 32 of the crimper 19 is brought into striking engagement with the pair of core wire crimping piece portions 51 of the metal terminal 50, so that the crimping is effected with a small friction developing between the mirror finished portion 39 and the pair of core wire crimping piece portions 51. Therefore, the pair of core wire crimping piece portions 51 are smoothly plastically deformed without being caught by the press-fastening portion 32, and is crimped to the core wire 62 of the electric wire 60 in a stable manner. And besides, it will be appreciated from FIG. 6 that even after the crimping operation is effected about 6,000 times, the surface hardly changes, that is to say, is almost the same as that in the unused condition of FIG. 5, and thus the press-fastening portion 32 is not worn.

As described above, in the crimping apparatus 10 of the first embodiment, when the crimper 19 is moved downward toward the anvil 20 having the base plate portion 53 of the metal terminal 50 placed thereon, the press-fastening portion 32 of the crimper 19 is brought into striking engagement with the pair of core wire crimping piece portions 51 of the metal terminal 50 to plastically deform these core wire crimping piece portions 51. At this time, since the mirror finished portion 39 is formed on the press-fastening portion 32 of the crimper 19 for striking against the pair of core wire crimping piece portions 51 of the metal terminal 50, a friction developing between the press-fastening portion 32 and the pair of core wire crimping piece portions 51 is small, and therefore the core wire crimping piece portions 51 can be stably crimped to the electric wire 60 by the press-fastening portion 32, and the mechanical performance and the electrical performance can be enhanced.

Furthermore, in the crimping apparatus 10, the mirror finished portion 39 has the surface roughness Ra of not more than 0.1 μm, and therefore the press-fastening portion 32 can be caused to strike against the core wire crimping piece portions 51 with a small friction, and therefore the pair of core wire crimping piece portions 51 can be plastically deformed in a stable manner while applying a crimping force uniformly to the core wire crimping piece portions 51.

Furthermore, in the crimping apparatus 10, when the crimper 19 is moved downward, the core wire crimping piece portions 51 of the metal terminal 50 are press-deformed (press-fastened) by the mirror finished portion 39 of the press-fastening portion 32, and therefore the pair of core wire crimping piece portions 51 can be more easily directed toward the core wire 62, and a force of striking of the distal end portions of the pair of core wire crimping piece portions 51 against each other is decreased, and therefore the pair of core wire crimping piece portions 51 can be caused to bite into the core wire 62 in a well-balanced manner.

Second Embodiment

Figure 7:
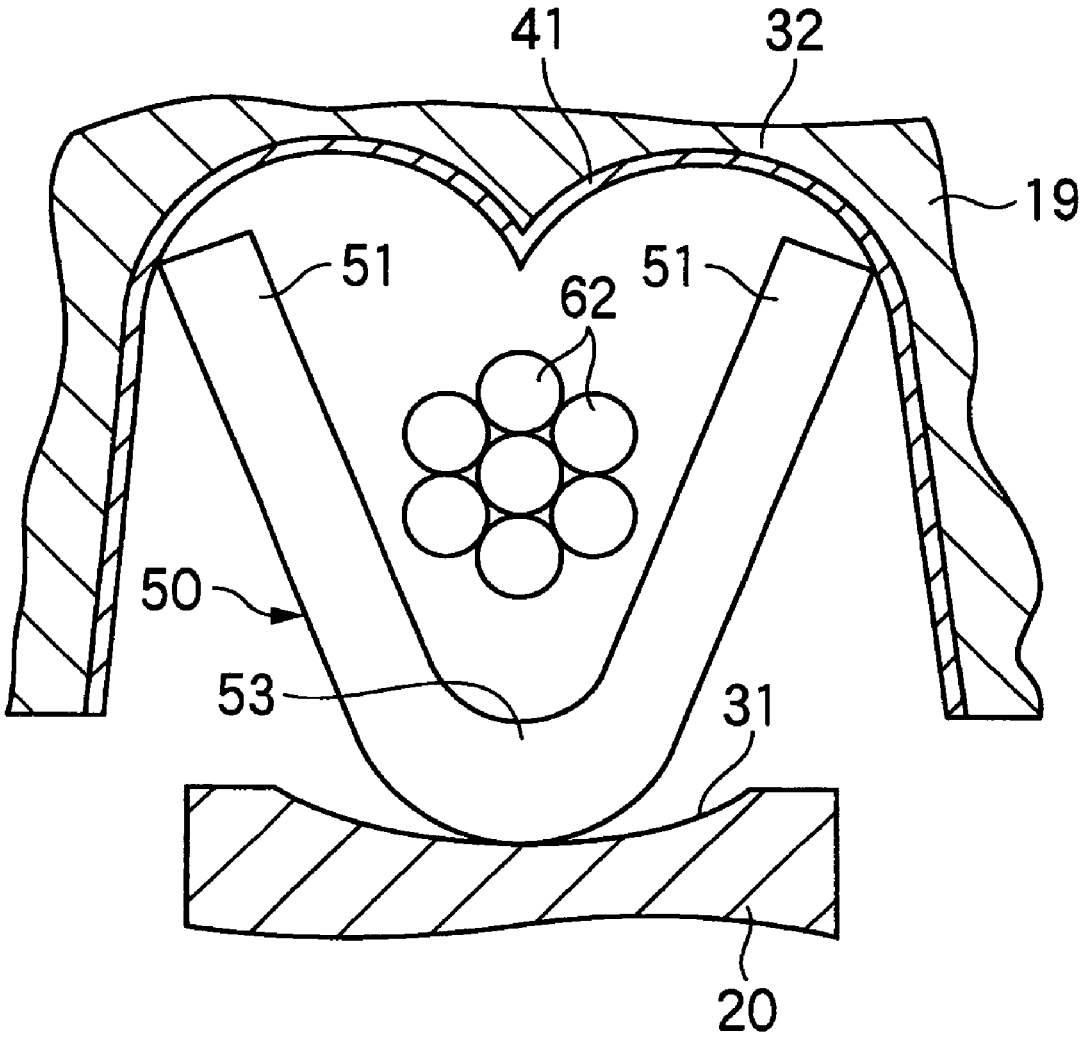
FIG. 7 is an enlarged cross-sectional view of an important portion of a second embodiment of a crimping apparatus of the invention.

Next, a second embodiment of a crimping apparatus of the invention will be described with reference to FIG. 7. FIG. 7 is an enlarged cross-sectional view of an important portion of the crimping apparatus of the second embodiment. In the following embodiments, those constituent elements identical or similar in function to those of the first embodiment will be designated by identical or like reference numerals, respectively, and description thereof will be briefly made or omitted.

In the crimping apparatus 10 of the second embodiment, a hard chrome plating layer 41 is formed on a surface of a press-fastening portion 32 of a crimper 19 as shown in FIG. 7. The hard chrome plating layer 41 has hardness of Hv 850 to 1000 or more, and has a thickness of 3 to 5 μm. The hard chrome plating layer 41 has high hardness, and therefore is excellent in wear resistance and durability.

When the crimper 19 is moved downward toward an anvil 20, the hard chrome plating layer 41 formed on the press-fastening portion 32 of the crimper 19 is brought into striking engagement with a pair of core wire crimping piece portions 51 of a metal terminal 50, so that the crimping is effected with a small friction developing between the hard chrome plating layer 41 and the pair of core wire crimping piece portions 51. Therefore, the pair of core wire crimping piece portions 51 are smoothly plastically deformed without being caught by the press-fastening portion 32, and is crimped to a core wire 62 of an electric wire 60 in a stable manner.

In the crimping apparatus 10 of the second embodiment, when the crimper 19 is moved downward toward the anvil 20 having a base plate portion 53 of the metal terminal 50 placed thereon, the press-fastening portion 32 of the crimper 19 is brought into striking engagement with the pair of core wire crimping piece portions 51 of the metal terminal 50 to plastically deform these core wire crimping piece portions 51. At this time, since the hard chrome plating layer 41 is formed on the press-fastening portion 32 of the crimper 19 for striking against the pair of core wire crimping piece portions 51 of the metal terminal 50, a friction developing between the press-fastening portion 32 and the pair of core wire crimping piece portions 51 is small, and therefore the core wire crimping piece portions 51 can be stably crimped to the electric wire 60 by the press-fastening portion 32. And besides, thanks to the formation of the hard chrome plating layer 41, the surface of the press-fastening portion 32 has increased hardness, and therefore is hardly worn. Therefore, the good surface condition can be maintained for a long period of time, so that the mechanical performance and the electrical performance can be enhanced.

Third Embodiment

Figure 8:
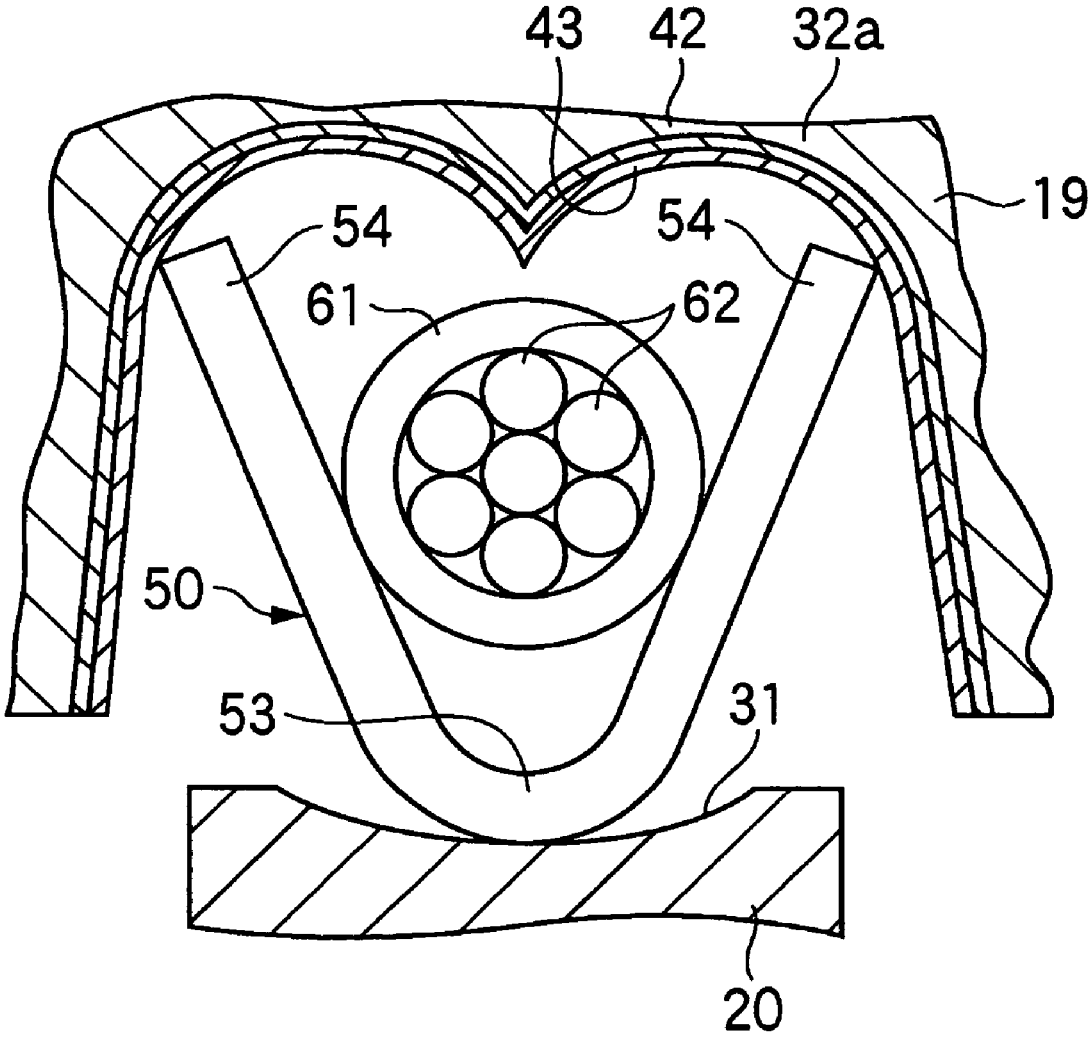
FIG. 8 is an enlarged cross-sectional view of an important portion of a third embodiment of a crimping apparatus of the invention.
Figure 9:
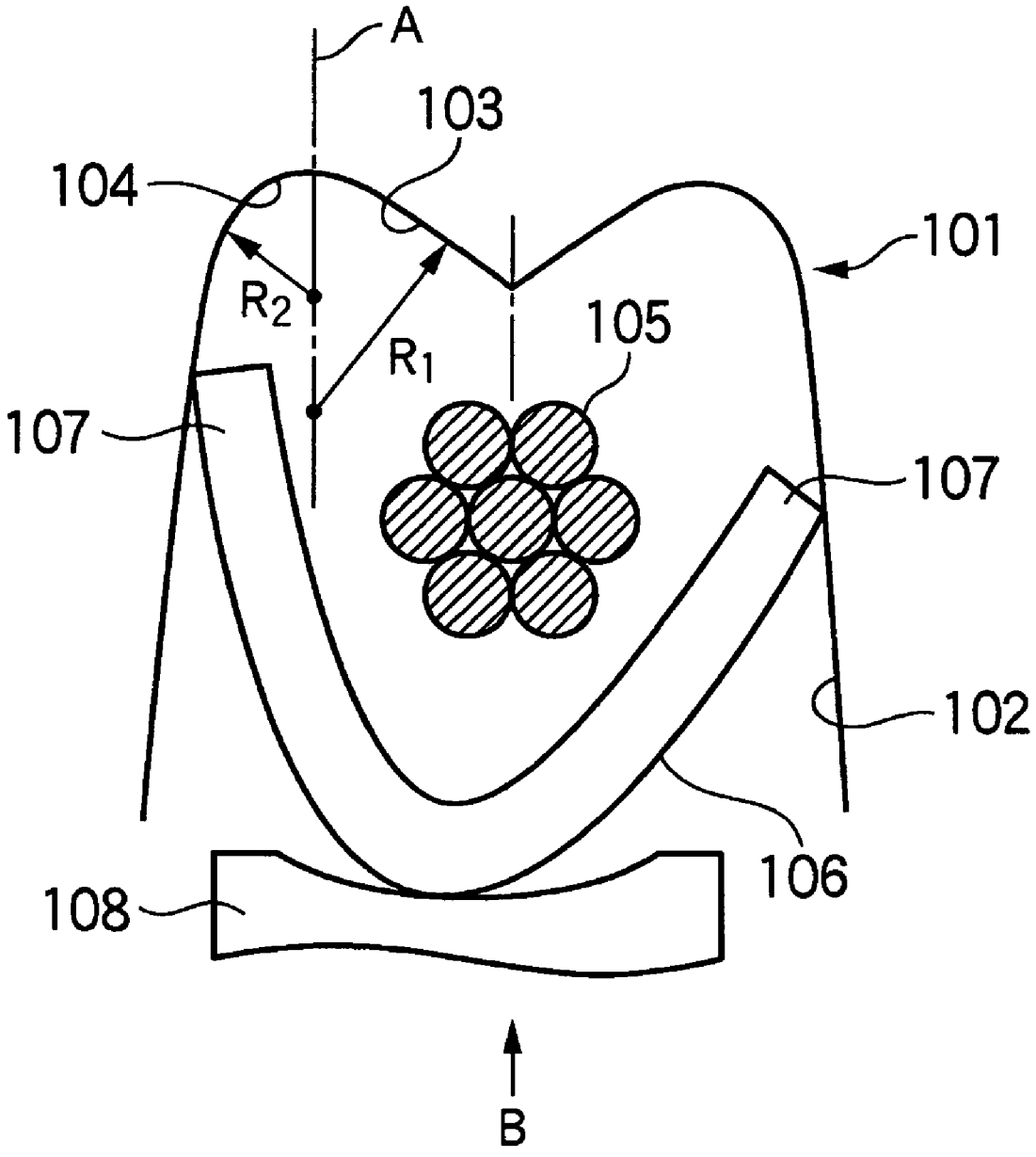
FIG. 9 is a schematic view of a conventional crimping apparatus.
Figure 10:
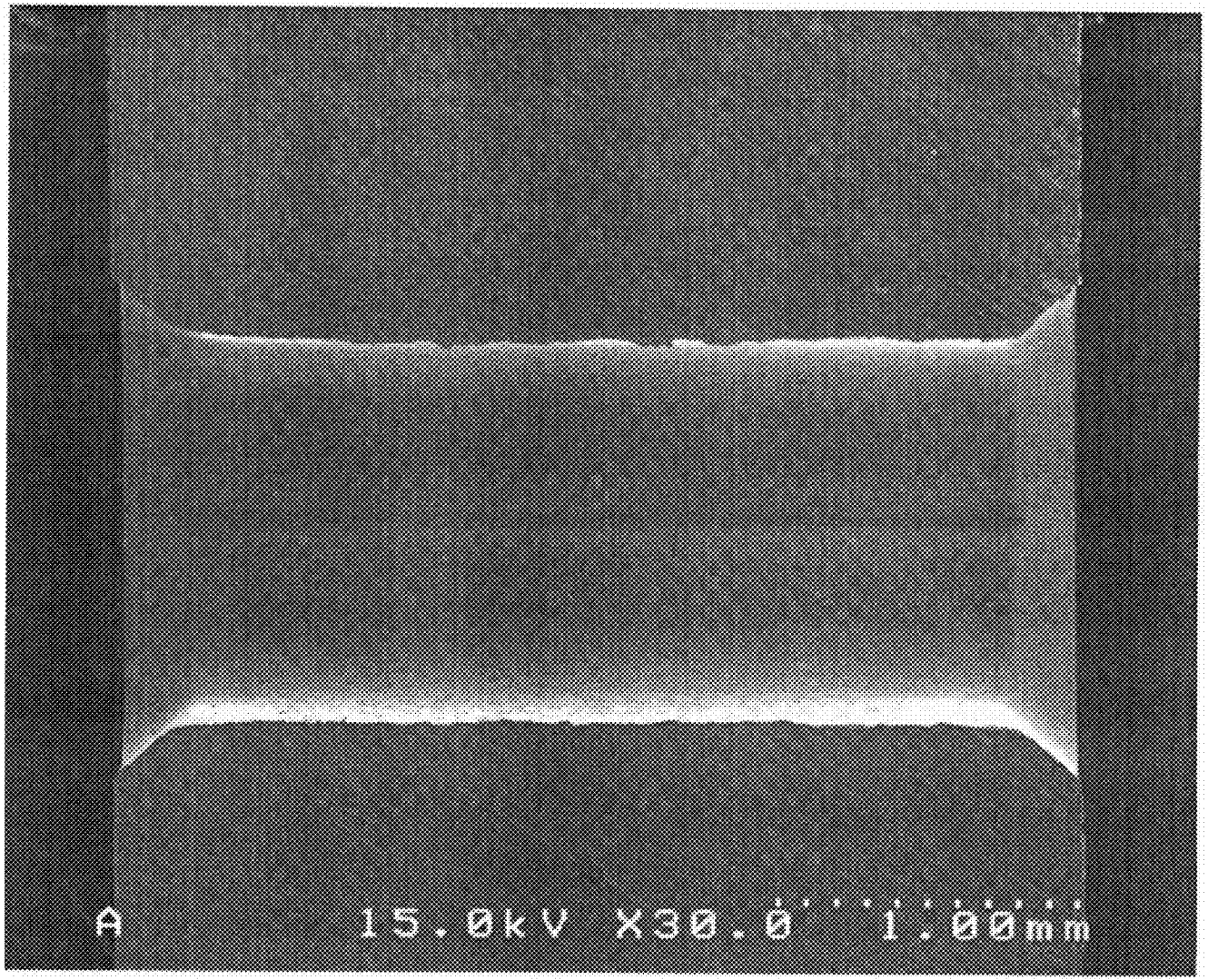
FIG. 10 is a view of a crimper of FIG. 9 in its unused condition as seen from a direction B of FIG. 9 (standard finishing)
Figure 11:
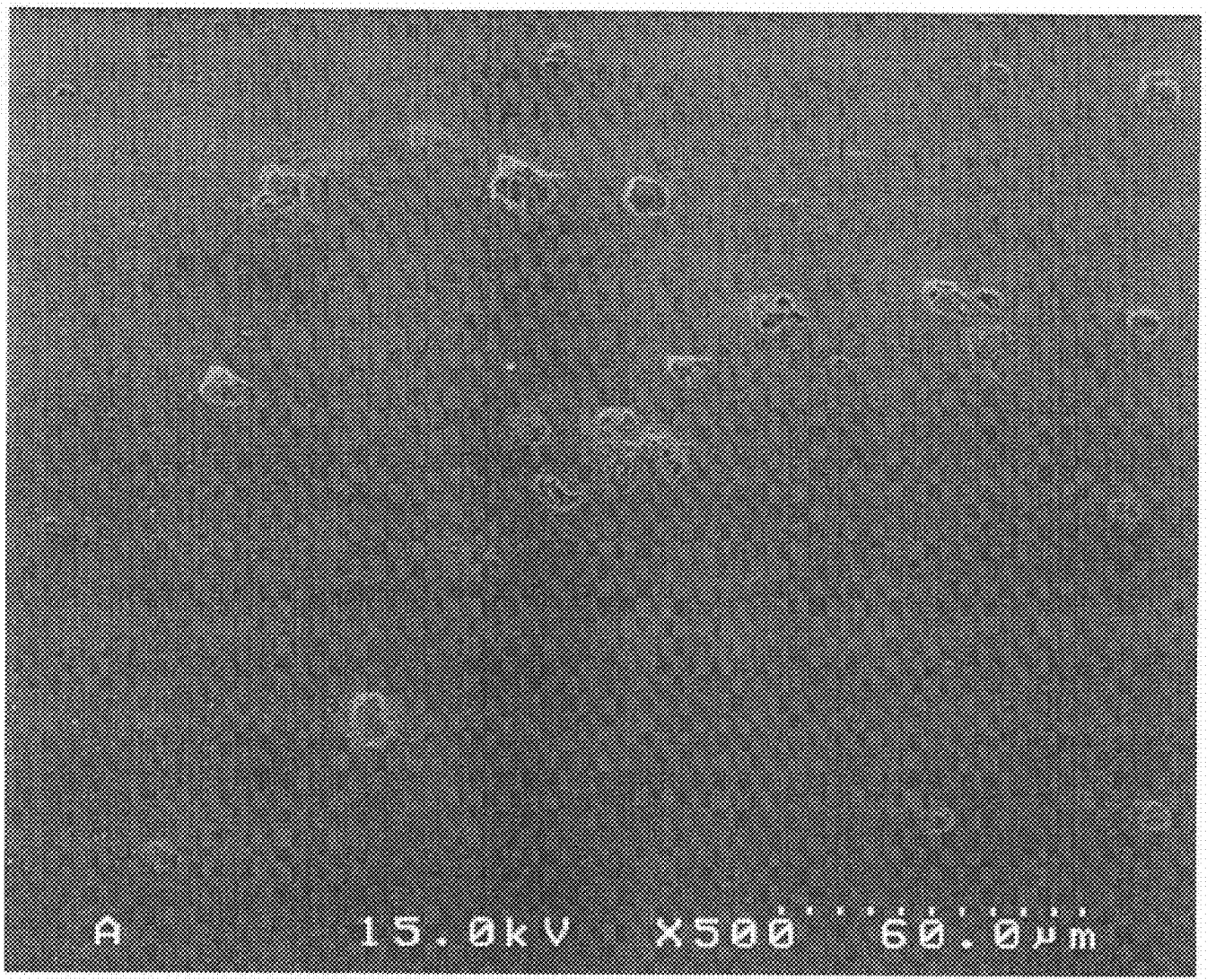
FIG. 11 is an enlarged view showing the surface of an arc-shaped portion (press-fastening portion) of FIG. 10.

Next, a third embodiment of a crimping apparatus of the invention will be described with reference to FIG. 8. FIG. 8 is an enlarged cross-sectional view of an important portion of the crimping apparatus of the third embodiment.

In the crimping apparatus 10 of the third embodiment, a mirror finished portion 42 having surface roughness of not more than 0.1 μm is formed on a surface of a sheath press-fastening 32*a* of a crimper 19, and further a hard chrome plating layer 43 is formed on the mirror finished portion 42 as shown in FIG. 8. The hard chrome plating layer 43 has hardness of Hv 850 to 1000 or more, and has a thickness of 3 to 5 μm.

When the crimper 19 is moved downward toward an anvil 20, the hard chrome plating layer 43 formed on the mirror finished portion 42 formed on the sheath press-fastening portion 32*a* of the crimper 19 is brought into striking engagement with a pair of sheath crimping piece portions 54 of a metal terminal 50, so that the crimping is effected with a small friction developing between the hard chrome plating layer 43 and the pair of sheath crimping piece portions 54. Therefore, the pair of sheath crimping piece portions 54 are smoothly plastically deformed without being caught by the sheath press-fastening portion 32*a*, and is crimped to a sheath 61 of an electric wire 60 in a stable manner.

In the crimping apparatus 10 of the third embodiment, when the crimper 19 is moved downward toward the anvil 20 having a base plate portion 53 of the metal terminal 50 placed thereon, the sheath press-fastening portion 32*a* of the crimper 19 is brought into striking engagement with the pair of sheath crimping piece portions 54 of the metal terminal 50 to plastically deform these sheath crimping piece portions 54. At this time, since the hard chrome plating layer 43 is formed on the mirror finished portion 42 formed on the sheath press-fastening portion 32*a* of the crimper 19 for striking against the pair of sheath crimping piece portions 54 of the metal terminal 50, a friction developing between the sheath press-fastening portion 32*a* and the pair of sheath crimping piece portions 54 is small, and therefore the sheath crimping piece portions 54 can be stably crimped to the electric wire 60 by the sheath press-fastening portion 32*a*. And besides, since the hard chrome plating layer 43 is further formed on the mirror finished portion 42, the surface of the sheath press-fastening portion 32*a* has increased hardness, and therefore is hardly worn. Therefore, the good surface condition can be maintained for a long period of time, so that the mechanical performance and the electrical performance can be enhanced.

The present invention is not limited to the above embodiments, and modifications, improvements, etc., can be suitably made. Furthermore, the material, dimensions, numerical value, form, number, disposition, etc., of each of the constituent elements of the above embodiments are arbitrary, and are not limited in so far as the invention can be achieved.

For example, the number of core wire elements jointly forming the core wire is not limited to the illustrated number, and a suitable number can be selected depending on the capacity of a circuit to which the electric wire is applied.

The present application is based on Japan Patent Application No. 2007-009137 filed on Jan. 18, 2007, the contents of which are incorporated herein for reference.

What is claimed is:

1. A crimping apparatus, comprising:

an anvil for supporting a metal terminal including a base plate portion for mounting an electric wire thereon and a pair of crimping piece portions extending upwardly respectively from opposite side edges of the base plate portion; and a crimper which has a press-fastening portion for press-fastening the crimping piece portions, wherein the anvil and the press-fastening portion of the crimper cooperate to press-fasten the crimping piece portions for crimping the crimping piece portions to the electric wire mounted on the metal terminal, and wherein the surface of the press-fastening portion has a mirror finish and a hard chrome plating layer provided thereon.

2. The crimping apparatus according to claim 1, wherein the mirror finish has surface roughness Ra of not more than 0.1 μm.

3. The crimping apparatus according to claim 1, wherein the hard chrome plating has a hardness of Hv 850 to 1000, and a thickness of 3 to 5 μm.

* * * * *